US010070687B2

(12) United States Patent
Lockyer

(10) Patent No.: US 10,070,687 B2
(45) Date of Patent: Sep. 11, 2018

(54) ARTICLE OF FOOTWEAR AND A PART THEREOF

(71) Applicant: REDBACKS CUSHIONING LTD., Northamptonshire (GB)

(72) Inventor: Clifford Lockyer, Warwickshire (GB)

(73) Assignee: Redbacks Cushioning Ltd., Daventry, Northamptonshire (GB)

( * ) Notice: Subject to any disclaimer, the term of this patent is extended or adjusted under 35 U.S.C. 154(b) by 48 days.

(21) Appl. No.: 14/401,997

(22) PCT Filed: May 20, 2013

(86) PCT No.: PCT/EP2013/060341
§ 371 (c)(1),
(2) Date: Nov. 18, 2014

(87) PCT Pub. No.: WO2013/171339
PCT Pub. Date: Nov. 21, 2013

(65) Prior Publication Data

US 2015/0128448 A1 May 14, 2015

(30) Foreign Application Priority Data

May 18, 2012 (GB) ..... 1208820.9
Mar. 22, 2013 (GB) ..... 1305314.5

(51) Int. Cl.
*A43B 13/04* (2006.01)
*A43B 13/14* (2006.01)
(Continued)

(52) U.S. Cl.
CPC ..... *A43B 13/18* (2013.01); *A43B 7/1415* (2013.01); *A43B 13/04* (2013.01); *A43B 13/14* (2013.01);
(Continued)

(58) Field of Classification Search
CPC ..... A43B 13/18; A43B 13/181; A43B 13/183; A43B 13/186; A43B 13/14; A43B 13/141;
(Continued)

(56) References Cited

U.S. PATENT DOCUMENTS 2,432,533 A 12/1947 Margolin
2,721,400 A * 10/1955 Israel ..... A43B 13/182 36/169
(Continued)

FOREIGN PATENT DOCUMENTS

DE 202006013488 U1 1/2008
EP 1745709 A1 1/2007
(Continued)

OTHER PUBLICATIONS

Search Report dated Sep. 10, 2012.
(Continued)

*Primary Examiner* — Khoa Huynh
*Assistant Examiner* — Jocelyn Bravo
(74) *Attorney, Agent, or Firm* — Wood, Phillips, Katz, Clark & Mortimer

(57) ABSTRACT

The invention relates to a sole, midsole, insole or sole insert for an article of footwear, such as a shoe or a boot, sandal, trainer or wellington boot. The sole, midsole, insole or sole insert 10 comprises a matrix structure 12 defining passageways 26, 30 extending between the upper and lower surfaces of the sole, midsole, insole or sole insert. The sole, midsole, insole or sole insert further comprises one or a plurality of sheet members 14, 16, 18, 20, 22 substantially within the matrix structure and forming a continuous molding therewith, the or each sheet member being convex so that the apex of the or each sheet member approaches and faces the upper surface of the sole, midsole, insole or sole insert. The
(Continued)

or each sheet member 14, 16, 18, 20, 22 is made from an elastomeric material so that each sheet member acts as a leaf spring.

23 Claims, 8 Drawing Sheets

(51) Int. Cl.
*A43B 13/18* (2006.01)
*A43B 17/14* (2006.01)
*A43B 7/14* (2006.01)
*A43B 13/41* (2006.01)

(52) U.S. Cl.
CPC ..... *A43B 13/141* (2013.01); *A43B 13/181* (2013.01); *A43B 13/183* (2013.01); *A43B 13/186* (2013.01); *A43B 13/41* (2013.01); *A43B 17/14* (2013.01)

(58) Field of Classification Search
CPC ... A43B 1/0009; A43B 13/1415; A43B 13/04; A43B 13/41; A43B 17/14
See application file for complete search history.

(56) References Cited

U.S. PATENT DOCUMENTS 4,611,412 A * 9/1986 Cohen ..... A43B 5/06 36/25 R
4,638,575 A * 1/1987 Illustrato ..... A43B 21/30 36/28
4,663,865 A 5/1987 Telecemian
4,739,765 A 4/1988 Sydor et al.
4,798,009 A * 1/1989 Colonel ..... A43B 13/185 36/28
4,901,987 A * 2/1990 Greenhill ..... F16F 1/06 267/166
5,337,492 A * 8/1994 Anderie ..... A43B 13/183 36/114
5,381,607 A * 1/1995 Sussmann ..... A43B 1/0009 36/28
5,461,800 A * 10/1995 Luthi ..... A43B 13/206 36/114
5,639,074 A * 6/1997 Greenhill ..... F16F 1/328 267/158
5,839,208 A 11/1998 Huang
6,006,449 A * 12/1999 Orlowski ..... A43B 13/182 36/27
6,068,250 A * 5/2000 Hawkins ..... F16F 1/328 267/148
6,231,946 B1 * 5/2001 Brown, Jr. ..... A43B 13/026 404/134
6,282,814 B1 * 9/2001 Krafsur ..... A43B 7/1425 36/27
6,618,959 B1 * 9/2003 Sussmann ..... A43B 1/0009 36/29
6,669,184 B2 * 12/2003 Cai ..... F16F 1/328 267/162
6,681,501 B1 1/2004 Polifroni
6,758,465 B1 * 7/2004 Greenhill ..... F16F 1/06 267/162
7,020,988 B1 4/2006 Holden et al.
7,475,497 B2 * 1/2009 Hoffer ..... A43B 1/0009 36/28
7,707,743 B2 * 5/2010 Schindler ..... A43B 1/0009 36/25 R
8,615,835 B2 * 12/2013 Hoffer ..... A43B 1/0009 12/142 R
9,204,680 B2 * 12/2015 Hoffer ..... A43B 1/0009
2001/0049888 A1 * 12/2001 Krafsur ..... A43B 7/1425 36/27
2009/0100722 A1 * 4/2009 Hoffer ..... A43B 1/0009 36/3 R
2010/0205829 A1 * 8/2010 Schindler ..... A43B 1/0009 36/28

FOREIGN PATENT DOCUMENTS

FR 2 800 581 A1 5/2001
GB 2467646 A 8/2010
WO 00/10414 A1 3/2000
WO 0028849 A1 5/2000
WO 0101806 A1 1/2001
WO 2009/072797 A1 6/2009

OTHER PUBLICATIONS

Revised Search Report dated Sep. 10, 2012.
Search Report dated Nov. 13, 2012.
International Search Report dated Aug. 14, 2013.
Written Opinion dated Aug. 14, 2013.

* cited by examiner

ARTICLE OF FOOTWEAR AND A PART THEREOF

The invention relates to an article of footwear and a part thereof, the part particularly but not exclusively comprising a sole, midsole, insole or sole insert for an article of footwear, such as a shoe or boot, sandal, trainer or wellington boot.

A known sole for a safety boot is made of solid rubber. There is a limit to the shock absorption which can be offered by a solid rubber sole. Also it is not possible to provide different levels of shock absorption in different areas of the sole without changing the thickness of the sole, which may be undesirable.

According to one aspect of the invention there is provided a part of an article of footwear, the part being arranged to lie beneath a user's foot in the article of footwear, the part comprising a matrix structure defining a plurality of passageways, each passageway extending between the upper and lower surfaces of the part, the part further comprising at least one sheet member substantially within the matrix structure and forming a continuous moulding therewith, the or each sheet member being convex, so that the apex of the or each sheet member approaches and faces the upper surface of the part, the or each sheet member being made from an elastomeric, material so that the or each sheet member acts as a leaf spring.

In this way, the part includes passageways to allow greater compression and cushioning, and the or each sheet member provides support where it is needed by flexing of the sheet member.

The part may be a sole, midsole, insole or sole insert for an article of footwear, such as a shoe or boot, sandal, trainer or wellington boot.

The or a sheet member may be provided in a heel part of the part to support a wearer's heel. Alternatively or additionally, a sheet member may be provided in an arch part of the part to support the arch of the wearer's foot. Alternatively or additionally, a sheet member may be provided in a position to support the ball of the user's foot. A sheet member may be provided in a position to support the ball of the big toe of the user's foot. A sheet member may be provided in a position to support the ball of the little toe of the user's foot A sheet member may be provided in a position to support the ball of one or more of the middle toes of the user's foot. Alternatively or additionally, a sheet member may be provided in a position to support the little toe of a user's foot. Thus support can be provided in specific positions where it is needed. Preferably, a plurality of sheet members is provided. Three sheet members may be provided under the ball of the wearer's foot, and they may be offset from one another to reflect the angle of the ball of a human foot.

The or each sheet member is preferably curved about an axis which is substantially perpendicular to the longitudinal axis of the part and preferably is substantially parallel to the plane of the part.

The or at least one sheet member may be curved about a single axis. This provides a shape which flexes more easily than if the sheet member were curved about more than one axis. Where the or a sheet member is provided in a position to support the wearer's heel, preferably that sheet member is curved about a single axis. Where at least one sheet member is provided in a position to support the ball of the wearer's foot, the or each such sheet member is preferably curved about a single axis. Where more than one sheet member is provided, the sheet members may be curved about axes which may be parallel and may be spaced from one another.

The or at least one sheet member may be curved about more than one axis and may be, for example, dome shaped. Where the or a sheet member is provided in a position to support the arch of a wearer's foot, the or each such sheet member may be curved about more than one axis. The sheet may be curved about two axes and may include a top part and three depending legs, one extending forwards, one rearwards and one across the foot in a direction away from the arch.

The matrix structure suitably includes a matrix of walls, which may be at an angle to the longitudinal axis of the sole, midsole or sole insert. In one embodiment, the matrix structure includes two sets of walls which intersect one another and are at substantially the same angle to the longitudinal axis of the sole, midsole or sole insert. In a particularly preferred embodiment, there are two sets of walls which are substantially perpendicular to each other and at substantially 45 degrees to the longitudinal axis of the sole, midsole or sole insert.

Suitably each passageway defines a longitudinal axis and the longitudinal axes may be substantially perpendicular to the upper and lower surfaces of the sole, midsole or sole insert. Preferably, the or each sheet member defines apertures aligned with the passageways which intersect therewith so that the passageways are not blocked.

The or each sheet member is preferably made of a stiffer material than the matrix structure. The or each sheet member may be made of a harder material than the matrix structure. Where a sheet member is in the arch, the sheet member may be made of stiffer material than any other sheet member of the part, in particular any sheet member which lies under the heel, ball or toe of the user's foot.

In the case of a sole insert, the sole insert may extend over substantially the entire sole of the shoe or boot. Alternatively, the sole insert may be smaller in size and may be designed to lie under particular parts of the wearer's foot, such as the parts which exert most pressure, such as the ball and/or heel. In a particularly preferred embodiment the sole insert lies only in the heel of the sole. The sole insert may take the form of a plug to be inserted into the sole of an article of footwear.

In the case of an insole, the insole may extend over substantially the entire sole of the shoe or boot. Alternatively, the insole may be smaller in size and may be designed to lie under particular parts of the wearer's foot, such as the parts which exert most pressure, such as the ball and/or heel.

A cover part may be provided to form a continuous surface to lie under a wearer's foot. This increases comfort. The cover part may be integral with the matrix structure, or may be a separate part to lie over the matrix structure. In that case, the cover part may include interlocking means to interengage with the matrix structure to hold the cover part in position with respect to the matrix structure. The cover part may be held in place by the article of footwear to hold the matrix structure in place and spaced from the sides of the sole. This is important to allow sufficient space for the matrix structure to move to absorb impact. A cover part may be provided to form a continuous surface to lie under the structure. This is particularly beneficial where the part is an insole, as it provides a surface to lie in contact with an existing shoe. The cover part may enclose the structure. The cover part may be rigid or semi-rigid, or in another embodiment, the cover part may be made of flexible material such as textile material, in particular where the cover part wraps and fully encloses the structure.

According to another aspect of the invention there is provided an article of footwear including a part according to the first aspect of the invention.

According to a further aspect of the invention there is provided an article of footwear including a midsole or sole insert according to the first aspect of the invention.

The article of footwear may include a sole defining a cavity in which the midsole or sole insert is provided and the cavity may be defined by a floor and a peripheral wall. The midsole or sole insert may be located in the cavity by locating means, and is preferably located such that there is a clearance all around between the midsole or sole insert and the peripheral wall. In order to cushion forces, the midsole or sole insert must be able to expand laterally, and this arrangement ensures it is able to do so. The locating means may take any suitable form, and may comprise at least one projection which is received in a passageway of the matrix to locate the midsole or sole insert. The or at least one projection may project from the peripheral wall, but preferably the or at least one projection projects from the floor. Alternatively, the locating means may comprise a cover part, interengaging with the matrix structure of the midsole or sole insert and the cover part being located by lateral engagement of the lateral edge of the cover part with the peripheral wall of the cavity in the sole, to thereby locate the midsole or sole insert in the cavity.

According to another aspect of the invention there is provided a cushioning pad comprising a matrix structure defining a plurality of passageways, each passageway extending between two opposed major surfaces of the pad, the pad further comprising at least one sheet member substantially within the matrix structure and forming a continuous moulding therewith, the or each sheet member being convex, so that the apex of the or each sheet member approaches and faces a major surface of the pad, the or each sheet member being made from an elastomeric material so that the or each sheet member acts as a leaf spring, the or at least one sheet member being curved about more than one axis and including a top part and at least three legs depending therefrom, each leg extending in a different direction around an axis of curvature of the sheet.

This enables absorption to take place by movement of the legs in several different directions.

In one embodiment of the invention, the cushioning pad is a sole, midsole, insole or sole insert for an article of footwear, such as a shoe or boot, and the sheet member is provided in a position to support or cushion the instep of the wearer's foot.

Embodiments of the invention will now be described, by way of example and with reference to the accompanying drawings, in which.

Figure 1:
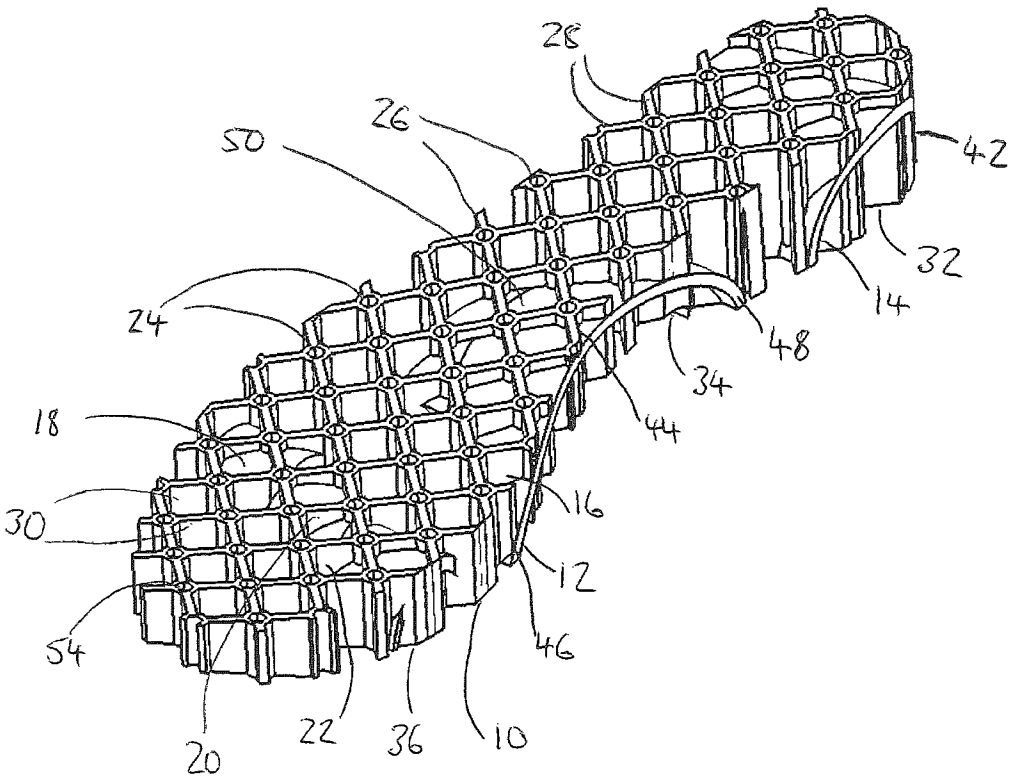
FIG. 1 is a perspective view of the midsole of the embodiment.
Figure 4:
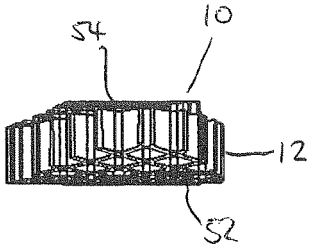
FIG. 4 is an end elevation of the midsole of FIG. 1.
Figure 2:
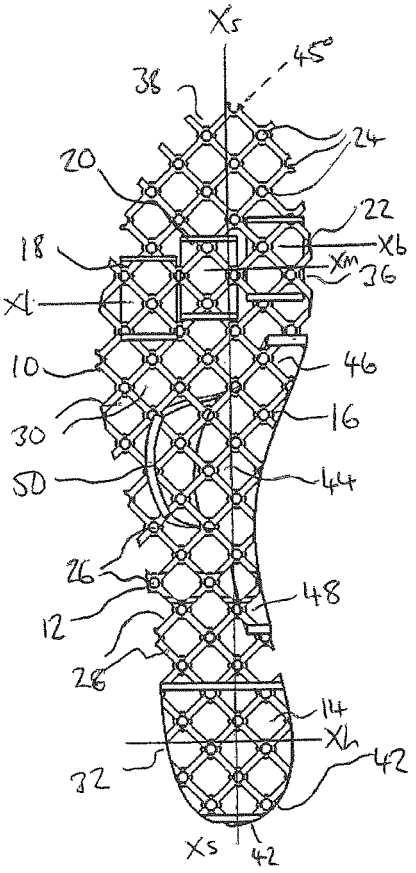
FIG. 2 is a top plan view of the midsole of FIG. 1.
Figure 3:
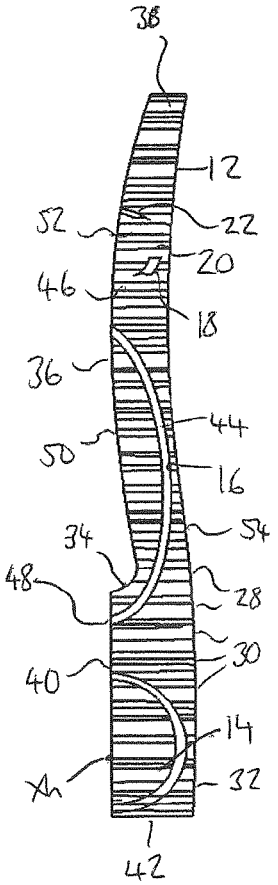
FIG. 3 is a side elevation of the midsole of FIG. 1.

The midsole 10 of the first embodiment includes a matrix structure 12 incorporating five sheet members 14, 16, 18, 20, 22.

The matrix structure 12 is made from a thermoplastic elastomer, such as SEBS. The matrix structure 12 comprises an array of cylindrical tubular elements 24 arranged with their longitudinal axes in parallel. The tubular elements 24 are arranged in a regular array. The tubular elements 24 define circular cross-section first passages 26. Each tubular element 24 is connected to adjacent tubular elements 24 by ribs 28. The ribs 28 form a rectangular lattice with a tubular element 24 at each intersection. Substantially square cross section passageways 30 are formed between four ribs 28. The passageways 26, 30 extend from the upper to the lower surface of the midsole 10 and are substantially perpendicular to the upper and lower surfaces of the midsole 10. The ribs 28 and tubular elements 24 can be 1 mm in thickness.

The shape of the outer envelope of the matrix structure 12 generally mimics the shape of a conventional sole for a shoe or boot, having a deeper heel section 32 at the back, leading through a step 34 on the underside to a shallower part 36 for the remainder of the foot, the shallower part being wider across the ball of the foot and rounded at the front end 38.

The rectangular lattice of the matrix is generally at 45 degrees to the longitudinal axis Xs of the midsole 10, that is, the ribs 28 are generally at 45 degrees to the axis Xs.

The sheet members 14, 16, 18, 20, 22 are made from a thermoplastic elastomer, such as SEBS. The sheet members 14, 16, 18, 20, 22 are injection moulded, and then the matrix structure 12 is injection moulded onto it by an overmoulding process so that the midsole 10 is an integral whole. The injection moulding uses either a 2K or a 1+1 tooling set up.

The first sheet member 14 is positioned in the heel section 32. The heel sheet member 14 is generally semi-cylindrical in shape being curved about an axis Xh which is parallel with the underside 40 of the heel section 32 and perpendicular to the longitudinal axis Xs of the midsole 10. The heel sheet member 14 extends from the rear edge 42 of the midsole 10 to a position before the step 34.

The second, third and fourth sheet members 18, 20, 22 are for the ball of the foot of the wearer. Like the heel sheet member 14, they are substantially semi-cylindrical, and each is curved about an axis Xb, Xm, Xl which is parallel to the axis Xh. The sheet members 18, 20, 22 are in a staggered line to reflect the angle of the ball of the foot to the longitudinal axis of the foot, and lie across the widest part of the midsole 10. The furthest forward sheet member 22 is to cushion the ball of the big toe of the foot. The middle sheet member 20 is to cushion the ball of the second and third toes of the foot. The furthest rearward sheet member 18 is to cushion the ball of the little toe or the little toe itself.

The final sheet member 16 is for the arch of the foot of the wearer and lies between the heel sheet member 14 and the other sheet members 18, 20, 22. The arch sheet member 16 is curved in two directions. It comprises a top part 44 and three legs 46, 48, 50. One leg 46 extends forwards from the top part 44 and another leg 48 extends rearwards from the top part 44. The forwards and rearwards legs 46, 48 and the top part 44 follow the contour of the right hand side of the midsole 10 and are curved about an axis which is parallel to the axes of the other sheet members 14, 18, 20, 22. The rearwards leg 48 intersects with the underside of the midsole 10 in the heel section 32 just behind the step 34. The third leg 50 extends sideways from the top part 44 and down in the direction away from the arch. The top part 44 and the third leg 48 are curved about an axis which is parallel to the longitudinal axis Xs of the midsole 10.

Figure 5:
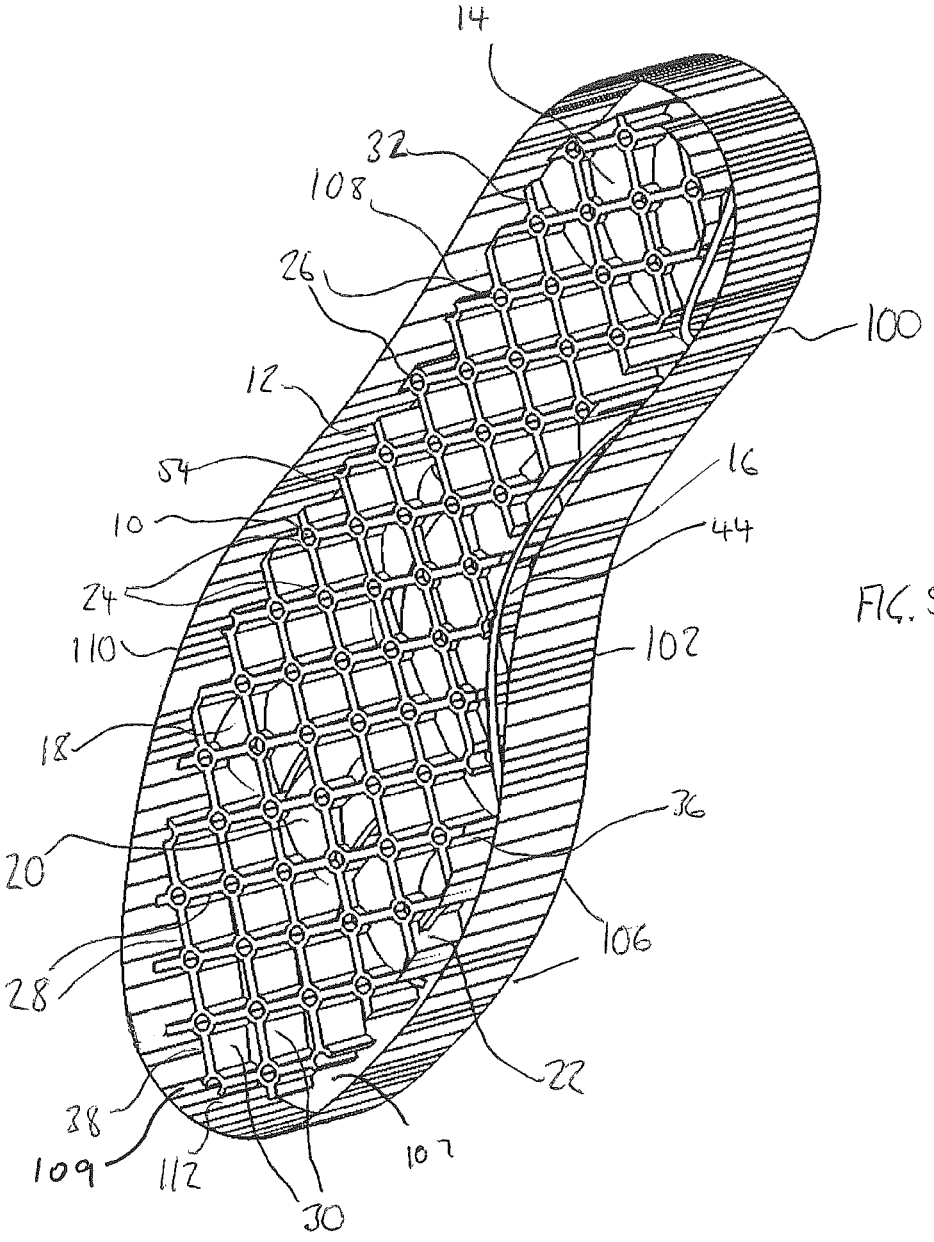
FIG. 5 is a perspective view of the midsole of FIG. 1 in a sole for a boot.

FIG. 5 shows the midsole 10 in a sole 100 for a boot. The sole 100 comprises a floor 102 and an upstanding peripheral wall 104 around the edge of the floor 102. The floor 102 has depending lands 106 on its underside to give grip. A cavity 108 is defined between the upper surface 107 of the floor 102 and the inner surface 109 of the wall 104 to receive the midsole 10. The midsole 10 lies with its underside 52 in continuous contact with the upper surface 107 of the floor 102 which has the same stepped shape. The upper surface 54 of the midsole 10 lies flush with the upper surface 110 of the wall 104. The wall 104 is wider and longer than the midsole 10 and has the same shape in plan so that there is a constant width clearance gap 112 between the side of the midsole 10 and the wall 104 all around. In order to locate the midsole 10 in this position and maintain the gap 112 all around, protrusions are provided on the upper surface of the floor 102 which are received in the large square passageways 30. The protrusions have a tree-like shape and are arranged in a row as a spine substantially along the longitudinal axis of the sole 100. The gap 112 can be 5 mm wide.

To finish the boot, an inner sole is placed over the midsole 10, and the upper is attached to the sole 100. In a work boot, the inner sole might include a metal plate layer for protection from electrical arcing.

In use, when a person wears the boot, the matrix structure 12 will provide support and cushioning over the whole of the underside of their foot. When the person takes a step, their heel will push into the midsole 10. This will compress the midsole 10 at the back, and additional support will be provided by the heel sheet member 14 which acts as a leaf spring. As the person rolls their foot forward, the arch sheet member 16 will provide additional support for the arch of the foot. The person will then put weight onto the ball of the foot and additional support in that area of the midsole 10 is provided by the sheet members 18, 20, 22 all across the ball of the foot.

The midsole 10 thus provides cushioning for the whole of the underside of the foot with additional reinforcement in the pressure areas where it is needed. The sheet members act as leaf springs bound to the matrix structure 12 and the fact that they are made from harder material than the matrix structure 12 further assists. The fact that the ribs 28 of the lattice of the matrix structure 12 are at 45 degrees to the axes about which the sheet members are curved further improves the resilient cushioning provided. As the ball of the foot is cushioned by three separate sheet members 18, 20, 22, support can be given substantially independently for the parts of the ball associated with different toes, and in particular if great pressure is put on the part of the ball of the foot for the big toe, support is still provided appropriately for the part of the ball for the other toes. The gap 112 ensures that the midsole 10 has room to expand sideways so that it can absorb pressure without lateral constraint.

Figure 6:
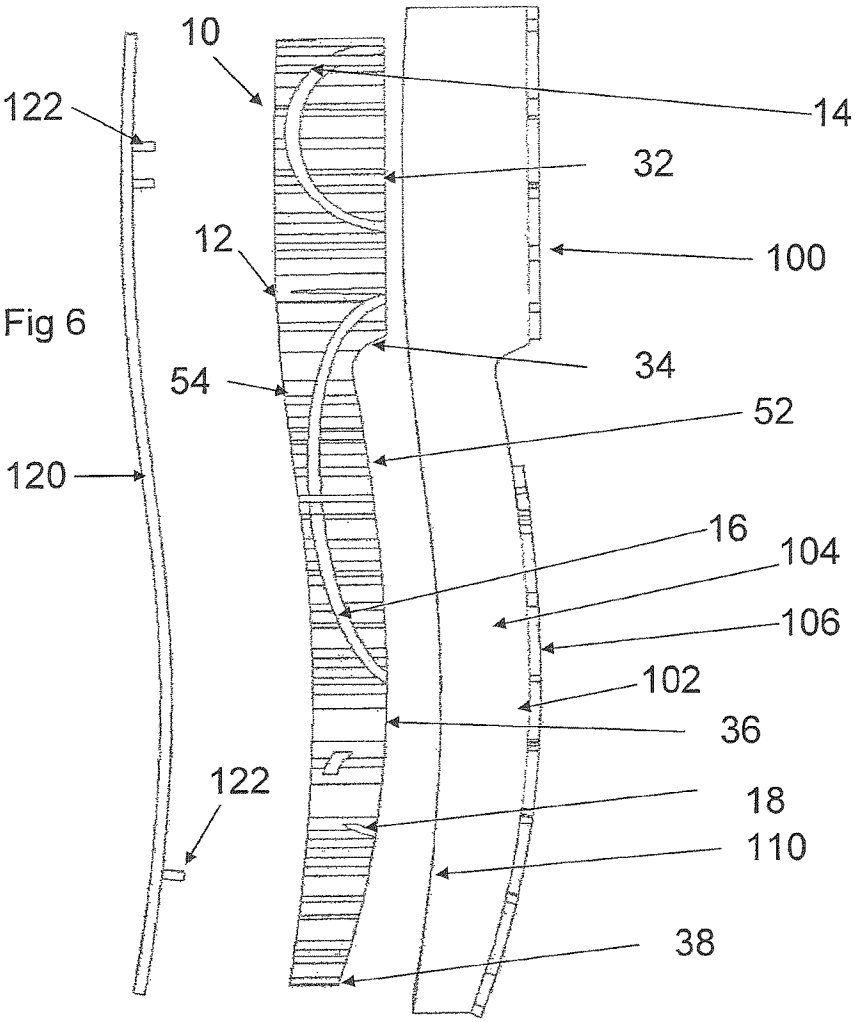
FIG. 6 is an exploded side elevation of a sole in a second embodiment.
Figure 7:
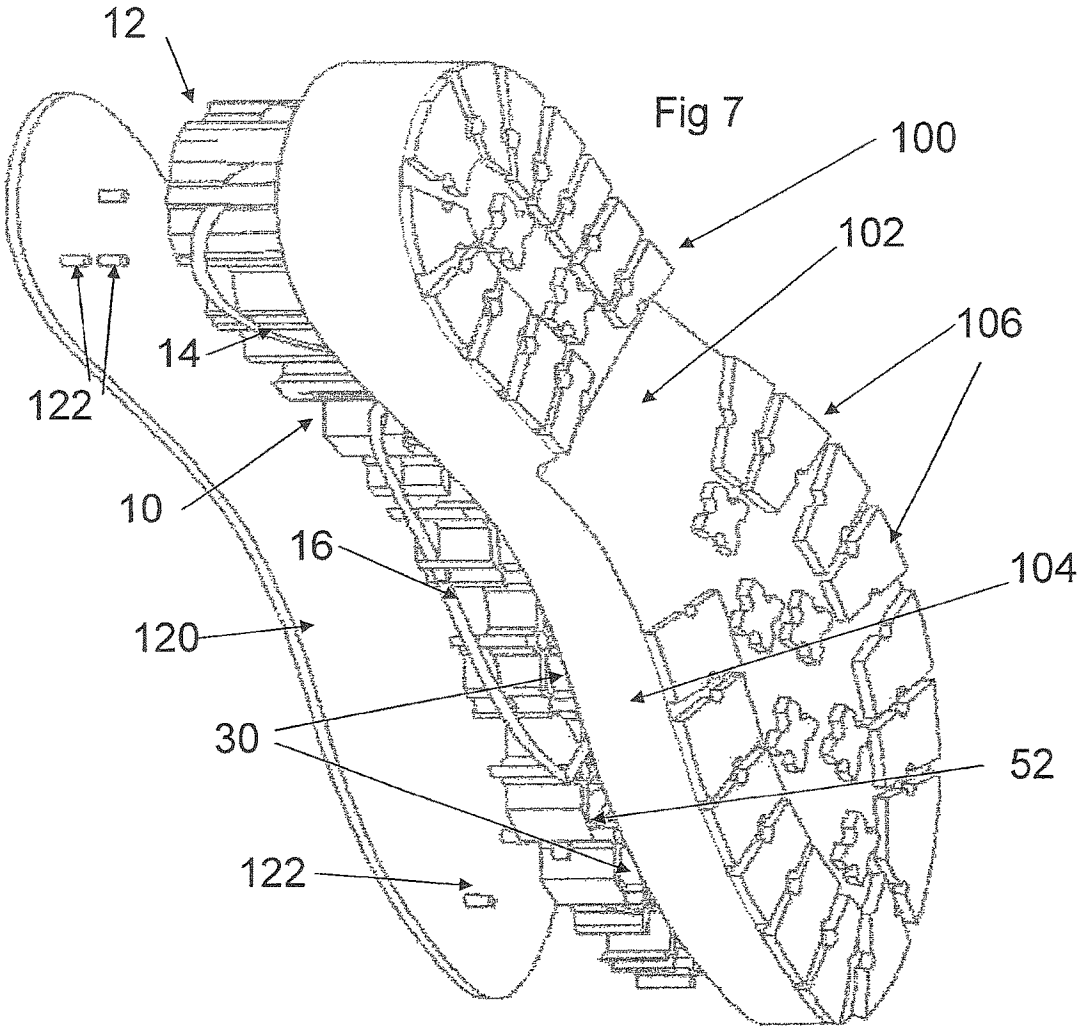
FIG. 7 is an exploded underneath perspective view of the sole of the second embodiment.

The second embodiment, shown in FIGS. 6 and 7, is similar to the first and only the differences from the first embodiment will be described. The same reference numerals will be used for equivalent features. In the second embodiment, the midsole 10 is not (or not only) held in place by the protrusions from the floor 102 of the sole 100. A cover part 120 is provided, which is rather like an inner sole. The cover part 120 is made of the same plastics material as the sheet members. The midsole 10 is not as tall as in the first embodiment, so that instead of lying flush with the upper edge 110 of the wall 104 of the sole 100, its upper surface 54 lies below the upper surface 110. The cover part 120 lies on top of the midsole 10 and within the top of the cavity 108. The cover part 120 is a close fit in the top of the cavity 108, so it touches the inner surface 109 of the wall 104 all around and is held in place laterally thereby. The cover part 120 includes an array of depending protrusions 122 which are received in the large square passageways 30 to locate the midsole 10 with respect to the sole 100. This preserves a lateral gap between the midsole 10 and the inner surface 109 of the wall 104, enabling the midsole to expand into the gap when it is compressed to absorb impact effectively.

In a further embodiment, the arch sheet member 16 is replaced by two sheet members, each curved in a single direction.

Although three sheet members 18, 20, 22 have been used to cushion the ball of the foot in this embodiment, in another embodiment a single long sheet member could be used instead, or two sheet members, for example one for the ball of the big toe and one for the ball of the other toes, or four sheet members or five sheet members, in which case there could be a sheet member for the part of the ball for each toe.

Clearly one or more of the sheet members could be omitted if desired. For example in another embodiment only the forwardmost sheet member 22 and the heel sheet member 14 are employed and the others are omitted.

In another embodiment, each sheet member 14, 16, 18, 20, 22 can include apertures corresponding to the passageways 30 so that the sheet members do not block the passageways 30.

Instead of using the part shown as a midsole, it could be used simply as a sole, by attaching it to the underside of a shoe in place of a conventional sole. The passageways 24, 30 would then provide grip.

Figures 8, 9:
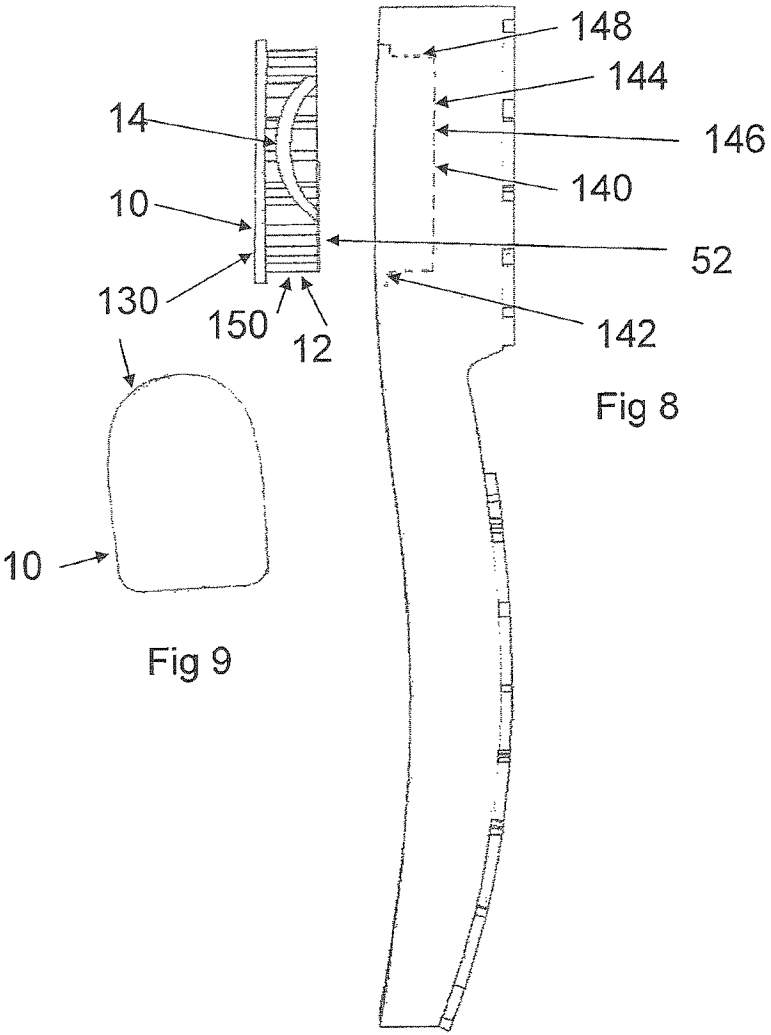
FIG. 8 is an an exploded side elevation of a sole in a third embodiment.
FIG. 9 is a plan view of the midsole of the third embodiment.
Figure 10:
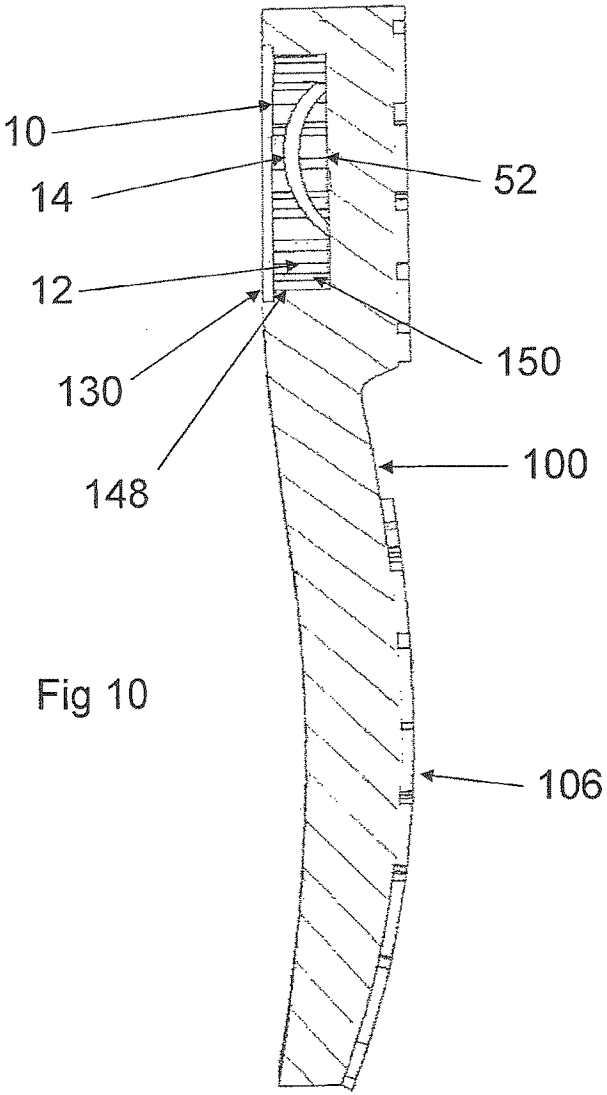
FIG. 10 is a side elevation in cross section of the assembled sole of the third embodiment.

In the third embodiment, shown in FIGS. 8, 9 and 10, a sole insert, which is much smaller than the midsole 10 is used. The same reference numerals will be used for equivalent features.

The sole insert 10 is smaller and is located in the heel of the sole 100 only. The sole insert 10 includes a main body which is similar to the heel part of the sole inserts of the first and second embodiments. Thus it includes a matrix structure 12 with a heel sheet member 14. The outer shape of the sole insert 10 in plan is substantially horse shoe shaped to follow the shape of the heel part of the sole. A generally planar cover part 130 is integral with the matrix structure and lies on top of the matrix structure 12. The cover part 130 is the same shape in plan as the matrix structure 12 but is larger so as to form an overhang all the way around the matrix structure 12.

The sole insert 10 is received in a complementary cavity 140 in the heel part of the sole 100. The cavity 140 mimics the shape of the sole insert 10, so it is countersunk including a wider part 142 at the top to receive the cover part 130 and a narrower part 144 to receive the matrix structure. The wider part 142 is a close fit with the cover part 130. The narrower part 144 has a side wall 148 which is spaced from the matrix structure 12 so that the matrix structure 12 has room to expand laterally and absorb impact in use. Thus, there is a gap of 3 mm between the wall 148 and the side 150 of the matrix structure 12 all around. The floor 52 of the sole insert 10 is in contact with the floor 146 of the cavity 140. The sole insert 10 is thus in the nature of a plug which is fitted into the cavity 140 in the heel of the sole 100.

In use, as the user walks in the shoe or boot, their heel will press down on the sole insert 10 which will be compressed between the user's heel and the floor 146 of the cavity 140 in the sole 100. The matrix structure 12 will flex and the sheet member 14 will act as a leaf spring so that the impact is absorbed. This increases comfort for the user and reduces the impact on the user's joints providing a medical advantage.

In another embodiment, a similar plug may be provided for the ball of the user's foot or just the ball of the big toe of the user's foot and/or a similar plug may be provided for the arch of the user's foot.

Figure 12:
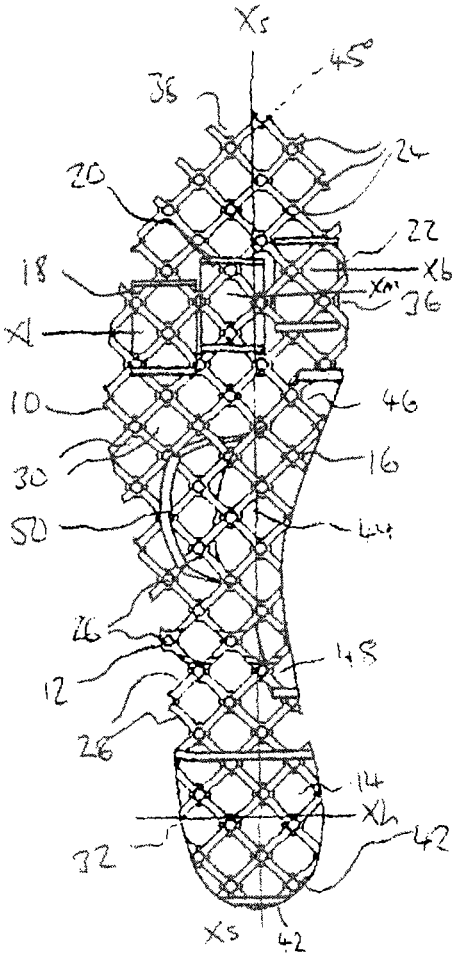
Figure 11:
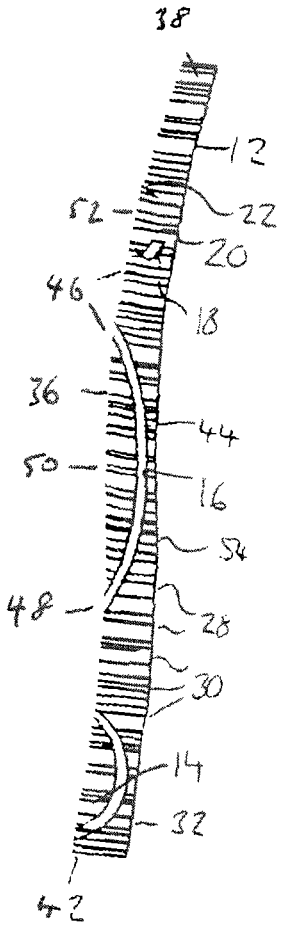
FIG. 11 is a side elevation of an insole in a fourth embodiment of the invention; and, FIG. 12 is a top plan view of the insole of FIG. 11.

FIGS. 11 and 12 show the fourth embodiment of the invention. The fourth embodiment is similar to the first embodiment and only the differences will be described. The same reference numerals will be used for equivalent features.

The fourth embodiment is an insole 10. Thus, the insole 10 is arranged to be inserted into an existing shoe to provide cushioning under the foot. The insole 10 of the fourth embodiment is similar in construction to the midsole of the first embodiment, but it lacks the deep heel section 32 at the back and instead is a substantially constant thickness of about 6 mm. The sheet members 14, 16, 18, 20, 22 are all still included in the same positions, but are shallower, in particular the heel sheet member 14.

The insole 10 may be used as shown, or may include a cover. The cover may cover the whole of the structure 12. Alternatively the cover may cover only one side of the structure 12. The cover may cover only the underside of the structure, or may cover only the top surface of the structure. The cover may be adhered to the structure 12. The cover may be made of textile material.

The insole 10 of the fourth embodiment allows existing shoes to benefit from the new technology as it can be retrofitted to any shoe.

In a variant on the fourth embodiment, the member 16 for the arch of the foot is omitted. Indeed in a further embodiment, the front and rear sections of the insole carrying the front sheet members 18, 20, 22 and rear heel sheet member 14 are connected by a sheet, which may be soft, for example made of foam or sponge plastics material, or may be thin and rigid, being made, for example, of rigid plastics material. This reduces this thickness of the central section of the insole for ease of insertion into the shoe. In a further variant, the front section carrying the front sheet members 18, 20, 22 may be separate from the rear, heel section carrying sheet 14. A user may use one or both parts, as required. Where the user is wearing high heeled shoes, very little weight may be on the back of the foot, and most of the weight on the front of the foot, through the ball of the foot and toes. Hence a user might just use the front part to cushion the front part of the foot.

The invention claimed is:

1. A part of an article of footwear, the part being arranged to lie beneath a user's foot in the article of footwear, the part comprising:

a matrix structure having upper and lower surfaces and a matrix of walls extending between the upper and lower surfaces, the matrix of walls defining a plurality of passageways, each passageway extending from the upper surface of the matrix structure to the lower surface of the matrix structure, the matrix structure further comprising a plurality of tubular elements defining at least some of said passageways; and at least one sheet member substantially located between the upper and lower surfaces of the matrix structure and forming a continuous molding therewith, the at least one sheet member being convex, so that the apex of the at least one sheet member approaches and faces the upper surface of the matrix structure, the at least one sheet member being made from an elastomeric material so that the at least one sheet member acts as a leaf spring, the at least one sheet member intersecting with at least one wall.

2. A part as claimed in claim 1, wherein the part has a heel part and the at least one sheet member is provided in the heel part of the part to support a wearer's heel.

3. A part as claimed in claim 1, wherein the part has an arch part and the at least one sheet member is provided in the arch part of the part to support the arch of the wearer's foot.

4. A part as claimed in claim 1, wherein the at least one sheet member is provided in a position to support the metatarsophalangeal joint of the user's foot.

5. A part as claimed in claim 1, wherein the at least one sheet member is provided in a position to support the ball of the big toe of the user's foot.

6. A part as claimed in claim 1, wherein the at least one sheet member is provided in a position to support the ball of the little toe of the user's foot.

7. A part as claimed in claim 1, wherein the at least one sheet member is provided in a position to support the ball of one or more of the middle toes of the user's foot.

8. A part as claimed in claim 1, wherein each of the at least one sheet member is curved about an axis which is substantially perpendicular to the longitudinal axis of the part.

9. A part as claimed in claim 1, wherein each of the at least one sheet member is curved about an axis which is substantially parallel to the plane of the part.

10. A part as claimed in claim 1, wherein the at least one sheet member is curved about a single axis.

11. A part as claimed in claim 10, wherein, where the at least one sheet member is provided in a position to support the wearer's heel, that sheet member is curved about a single axis.

12. A part as claimed in claim 1, wherein the at least one sheet member is curved about more than one axis.

13. A part as claimed in claim 1, wherein a plurality of sheet members are provided.

14. A part as claimed in claim 13, wherein a plurality of sheet members are configured to be provided under the metatarsophalangeal joint of the wearer's foot.

15. A part as claimed in claim 1, wherein each of the at least one sheet member is made of a stiffer material than the matrix structure.

16. A part as claimed in claim 1, wherein each of the at least one sheet member is made of a harder material than the matrix structure.

17. A part as claimed in claim 1, wherein a cover part is provided to lie over the matrix structure under the user's foot, the cover part including interlocking means to interengage with the matrix structure to hold the cover part and matrix structure in position with respect to one another.

18. A part as claimed in claim 1, wherein the part is a sole insert.

19. A part as claimed in claim 18, wherein the sole insert is designed to lie only in the heel of the sole of the article of footwear.

20. A part as claimed in claim 18, wherein the sole insert is designed to lie only in the part of the sole which lies under the metatarsophalangeal joint of the user's foot.

21. A part as claimed in claim 18, wherein the sole insert is designed to lie only in the arch of the sole.

22. A part as claimed in claim 18, wherein the sole insert is in the form of a plug to be inserted into a cavity in the sole of the article of footwear.

23. A part of an article of footwear, the part having a heel part and being arranged to lie beneath a user's foot in the article of footwear, the part comprising:

a matrix structure having upper and lower surfaces and a matrix of walls extending between the upper and lower surfaces, the matrix of walls defining a plurality of passageways, each passageway extending from the upper surface of the matrix structure to the lower surface of the matrix structure, the matrix structure further comprising a plurality of tubular elements defining at least some of said passageways; and at least two sheet members substantially located between the upper and lower surfaces of the matrix structure and forming a continuous molding therewith, each sheet member being convex, so that the apex of each sheet member approaches and faces the upper surface of the matrix structure, each sheet member being made from an elastomeric material so that the at least one sheet member acts as a leaf spring, each sheet member being made of a harder material than the matrix structure, one sheet member being provided in the heel part of the part to support the user's heel, and at least one other sheet member being provided in a position to support at least part of the metatarsophalangeal joint of the user's foot, each sheet member intersecting with at least one wall.

* * * * *